United States Patent [19]

Filippi et al.

[11] Patent Number: 4,699,112

[45] Date of Patent: Oct. 13, 1987

[54] FUEL INJECTION PUMP FOR DIESEL ENGINES

[75] Inventors: Renato Filippi, Nichelino; Sergio Turchi, Rivalta Torinese, both of Italy

[73] Assignee: Weber S.p.A. Azienda Altecna, Turin, Italy

[21] Appl. No.: 795,599

[22] Filed: Nov. 6, 1985

[30] Foreign Application Priority Data

Feb. 15, 1985 [IT] Italy ..... 67163 A/85

[51] Int. Cl.[4] ..... F02M 45/00; F02M 59/22

[52] U.S. Cl. ..... 123/506; 123/512; 417/499

[58] Field of Search ..... 123/495, 496, 457, 459, 123/460, 462, 506, 458, 446, 511, 512; 417/494, 499

[56] References Cited

U.S. PATENT DOCUMENTS

| | | | |
|---|---|---|---|
| 2,918,048 | 12/1959 | Aldinger et al. | 123/459 |
| 3,340,860 | 9/1967 | Groschel et al. | 123/457 |
| 4,074,668 | 2/1978 | Indra | 123/506 X |
| 4,099,894 | 7/1978 | Indra | 417/499 |
| 4,165,723 | 8/1979 | Straubel | 123/506 X |
| 4,577,606 | 3/1986 | Bohringer et al. | 123/506 |

*Primary Examiner*—Tony M. Argenbright

*Attorney, Agent, or Firm*—Sughrue, Mion, Zinn, Macpeak and Seas

[57] ABSTRACT

A fuel injection pump for diesel engines, in which the pressure chamber of each cylinder (10) is defined on its side opposite the piston (16) by a slide valve (38) movable in a direction opposite the piston against the action of resilient biasing means (52). The slide valve is sensitive to the supply pressure of the fuel and controls communication between the pressure chamber and the fuel delivery passage (44, 46). The supply pressure is controlled by external modulating means which varies the equilibrium position of the slide valve. The slide valve allows the initial alteration of the effective delivery, and hence the effective injection advance, in dependence on the running conditions/load of the engine.

2 Claims, 1 Drawing Figure

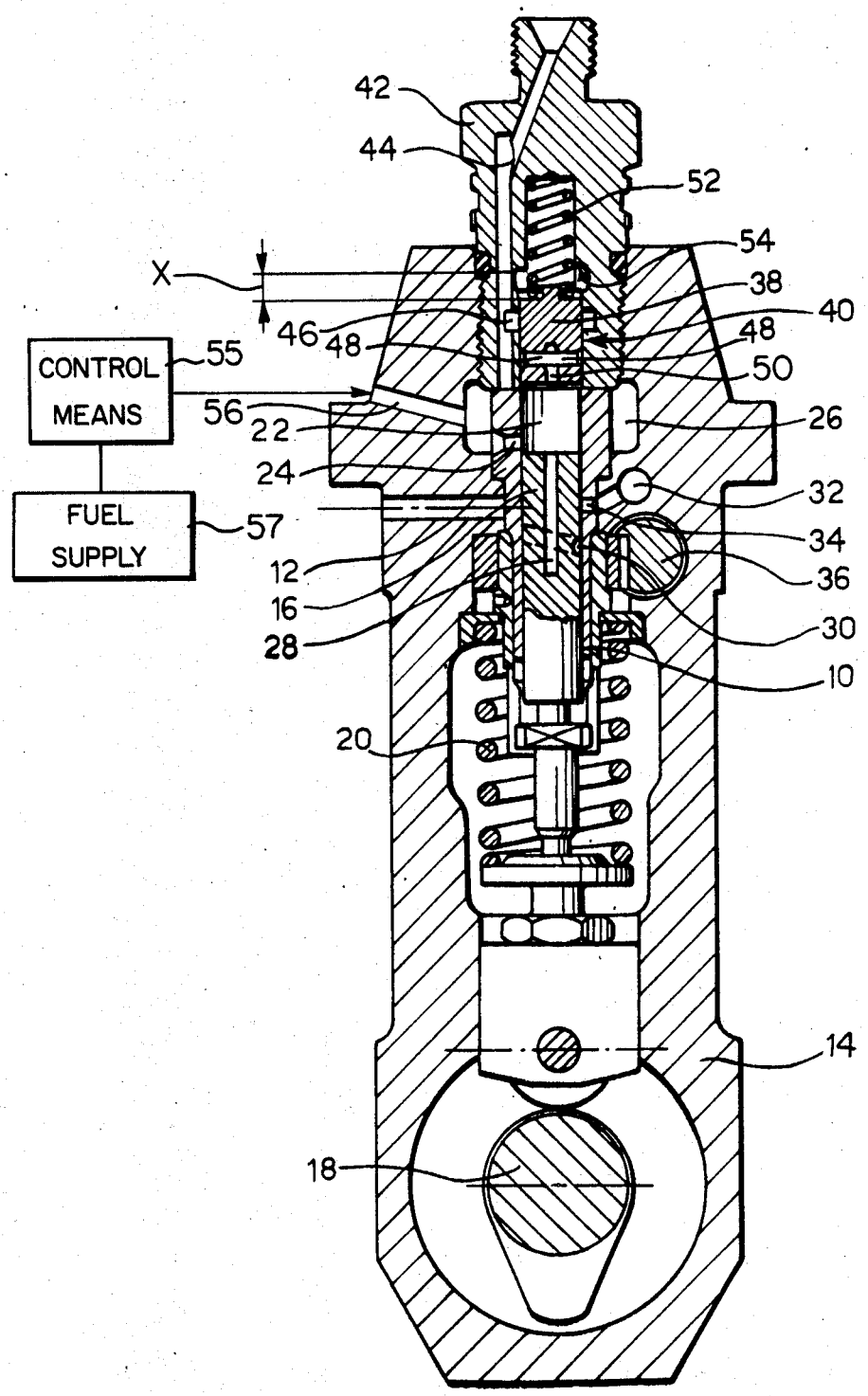
42
44
52
54
X
38
40
46
48
48
50
CONTROL MEANS
55
56
22
26
24
32
FUEL SUPPLY
57
34
12
36
16
30
28
10
20
14
18

FUEL INJECTION PUMP FOR DIESEL ENGINES

The present invention relates to fuel injection pumps for diesel engines for motor vehicles, of the type (called a "jerk-pump") including at least one cylinder defining a pressure chamber communicating with a radial fuel intake opening and connectible to a passage for delivering the pumped fuel to the injector. A piston is sealingly and reciprocatingly slidable in the cylinder and is arranged to cut-off communication between the pressure chamber and the fuel intake opening during its pumping stroke. The piston is angularly movable in the cylinder and in its lateral surface has a helical groove which communicates with an axial hole in the piston opening into the pressure chamber, and which cooperates with a fuel return opening for regulating the delivery through the angular movement of the piston by an external regulating member.

In injection pumps of the type specified above, the injection advance is fixed independently of the running conditions or load on the engine to which the pump is fitted. In fact, in such conventional pumps, it is possible to alter the start or the end of the fuel delivery solely by means of the external regulating member, without considering effective running conditions of the engine and, at best, taking account of the load thereon.

The object of the present invention, therefore, is to provide an injection pump of the type defined at the beginning, in which the start of the fuel delivery, or the injection advance, is variable in dependence on the running conditions/load of the engine, as necessary for its optimization, through the effect of the fuel supply pressure.

According to the invention, this object is achieved by virtue of the fact that a slide valve is inserted in the pumping column, which defines that side of the pressure chamber opposite the piston and is movable in the direction of the pumping movement of the piston against the action of a resilient biasing member. This slide valve, the position of which depends on the supply pressure of the fuel, controls communication between the pressure chamber and the fuel delivery passage to the injector in such a way, for example, as to open this communication after the interruption of communication between the pressure chamber and the fuel intake opening by the piston.

In practice, the position of the slide valve during the supply phase to the delivery chamber is defined on one side by the reaction load of the resilient member and on the other side (the delivery chamber side) by the level of the supply pressure modulated by independent external control means. The effective delivery initiation is defined by the moment when the slide, which is moved from the equilibrium position as a result of the pressure generated by the pumping piston upon closure of the supply openings to the cylinder, hits a suitable seat of the delivery connector.

The slide also acts as a distributor proper, controlling the communication between the delivery chamber and the high-pressure supply duct to the injector. This communication is opened (to a predetermined extent) after the closure of the fuel supply openings of the delivery chamber, a closure effected by the pumping piston. The system may also operate by always keeping open the communication opening in the slide between the delivery chamber and the high-pressure duct to the injector.

The variation in the injection advance which results, compared to conventional pumps in which the delivery advance is defined by the closure of the supply openings to the cylinder, is dependent on the volume of fuel moved by the slide from the position of equilibrium (defined by the fuel supply pressure in the rest phase of the cycle) to the moment of impact of the slide on its seat at the end of its travel.

If the supply pressure is altered, the starting position of the slide is consequently changed, varying the impact travel and hence the degree of advance.

The effect of altering the position of delivery initiation on the introduction of fuel for the same position of the regulating sleeve is clear. The metering of fuel will thus be dependent both on the position of the piston (provided with the conventional regulating helix) and on the supply pressure which causes the positioning of the slide valve. The control of these two functions (piston position and supply pressure) by mechanical/hydraulic or electronic regulators allows the desired fuel metering and injection advance to be obtained. This system allows the effective delivery initiation, and hence the effective injection advance, to be altered independently of the closure of the supply openings upon pumping, but as required by the engine in dependence on its running conditions/load, by suitable modulation of the supply pressure.

By virtue of this characteristic, the injection pump according to the invention, compared to conventional injection pumps whose injection advance is fixed independently of the running conditions/load of the engine, allows the following advantages to be achieved:

1—rendering the start of the fuel delivery variable by means of the slide valve;

2—varying the introduction of the fuel both through the conventional helical regulating groove with which the piston is provided and by using the variation in the delivery initiation mentioned in point 1;

3—acting on the parameters of points 1 and 2 so as to render the initiation and end of the delivery variable;

4—achieving what is indicated in point 3 by means of the supply pressure (supplied by an external or internal source of the system) which is regulated independently of the speed of rotation and is complemented by mechanical regulation through the positioning of the helical groove in the piston;

5—preventing the partial evacuation of the tubing of the pump by means of a hydraulic barrier (the supply pressure itself indicated in the preceding point) so as to eliminate the expansion valve with which conventional pumps are provided;

6—making the supply of fuel to the pump independent of the discharge at the end of delivery.

According to the invention, the slide valve is inserted in a tubular connector which is fitted to the top of the cylinder and has an internal circumferential groove communicating with the delivery passage and arranged to be put into communication with the pressure chamber through internal passages in the slide valve at the end of its travel (or in an intermediate phase of its travel or even at the beginning of its travel) against the action of the resilient biasing member.

The invention will now be described in detail with reference to the appended drawing, provided purely by way of non-limiting example, which is a vertical schematic section of an injection pump according to the invention.

The drawing illustrates one of the pumping units of a multi-cylinder in-line injection pump for diesel engines.

In short, this unit comprises a cylinder 10 formed by the cavity of a tubular element 12 inserted in the body 14 of the pump and in which a piston 16 is sealingly slidable. The reciprocating sliding of the piston 16 is driven in known manner by a cam 18 with the aid of a biasing spring 20.

The upper part of the cylinder 10 defines a pressure chamber 22 which communicates through a radial opening 24 with an annular chamber 26 communicating with a fuel supply duct. The communication between the delivery opening 24 and the pressure chamber 22 is interrupted during each delivery stroke of the pistons 16, in known manner.

An axial hole 28 is also formed in the piston 16 and communicates with a helical groove 30 formed in a conventional manner in the lateral surface of the piston 16 and by means of which the pressure chamber 22 can be put into communication with a discharge passage 32 through a radial return opening 34. This communication is achieved in known manner through the rotation of the piston 16 about its own axis by means of a slidable rack 36 operated by the accelerator of the engine.

According to the invention, the pressure chamber 22 is defined on its side opposite the piston 16 by a slide valve 38 which is slidable in a cavity 40 formed in a pressure connector 42 fitted to the top of the body 14 as a replacement for the normal delivery valves with which these pumps are usually provided.

The pressure connector 42 has a passage 44 for connection to an injector and communicating with an annular chamber 46 sealingly surrounding the slide 38. In its turn, the latter is provided with a series of radial passages 48 opening into an axial passage 50 in permanent communication with the pressure chamber 22.

The slide valve 38 is movable axially against the action of a biasing spring 52 (replaceable by an equivalent elastic system) between a rest position established by the supply pressure, in which it is displaced towards the piston 16 and the radial passages 48 are staggered axially relative to the chamber 46, and an operative position defining the actual start of pumping, in which it bears against a stop portion 54 of the connector 42 and the passages 48 are located in axial correspondence with the annular chamber 46. In this operative position, communication between the pressure chamber 22 and the delivery passage 44 is open.

The pump according to the invention operates as follows.

As stated above, fuel is supplied to the pump through the intake opening 24. The slide 38, biased by the spring 52, disposes itself in a position of equilibrium dependent on the supply pressure and the load of the spring 52. The supply pressure can be modulated by external control means 55. The control means regulates the amount of fuel delivered to chamber 22 through a fuel supply duct 56 prior to the initial movement of piston 10. By regulating the amount of fuel delivered to the chamber 22 from fuel supply 57, the equilibrium position of the slide 38 can be varied to determine the distance X the slide 38 must travel to align corresponding fuel passages 48 and 46 and inject the fuel.

The fuel delivery initiation is defined by the movement of the piston 16. This initiation does not occur upon the closure of the intake opening 24 by the piston 16 but afterwards, at the moment when the slide 38 hits the stop 54 of the connector 42 to put the pressure chamber 22 into communication with the delivery passage 44 through the opening 46 and the passages 48 and 50 before the impact. In fact, from the moment of closure of the intake opening 24 to the impact of the slide 38 only a transfer of the volume of the fuel occurs. In limit conditions, this transfer may be made equal to zero.

The end of delivery, however, is defined by the opening of the discharge between the helical groove 30 in the piston 16 and the return opening 34 communicating with the discharge passage 32.

As stated above, the initiation of the delivery of fuel to the injector associated with the passage 44 is defined by the moment when the slide 38 hits the stop 54 of the connector 42. The travel of the slide 38 (which is a function of the diameter of the slide 38 and the flexibility of the spring 52 or the equivalent elastic system consequent on the required advance laws) generates a "transfer" volume equal to that generated by the piston 16 at the moment of closure of the intake opening 24.

The stroke of the piston 16 from the closure of the intake opening 24 to the effective delivery initiation (consequent on the transfer of volume) corresponds to a certain angle of rotation of the cam shaft 18. This (variable) angle added to the (fixed) angle of the relevant cam from the bottom dead centre position of the piston 16 upon closure of the intake opening 24 defines the cam angle corresponding to the effective initiation of the delivery.

With the variation of the injection advance in dependence on the running conditions/load of the engine achieved by a change in the travel of the slide valve 38 (by means of the supply pressure), it is necessary to link the variation in the transfer volume (and the consequent moment of effective initiation of the delivery) to the delivery stroke which must provide the amount of fuel required by the engine.

This is achieved by means of the helical groove 30 in the piston 16 which, piloted by the pump regulating rod, defines the moment when the delivery ends. This is all achieved by means of an external control (accelerator pedal) acting on the regulating rack 36.

The external control system for the delivery rate should thus operate by combining the regulation of the supply pressure with the travel of the rack 36.

It should be noted that, by virtue of the arrangement described above, the delivery valves characteristic of conventional pumps may be eliminated from the pump according to the invention.

Finally, it must be noted that the control of the delivery initiation by the running conditions/load of the engine in the manner described can be applied to single cylinder pumps or rotary pumps, as well as to multi-cylinder in-line injection pumps.

Naturally, the constructional details and forms of embodiment may be varied widely with respect to those described and illustrated, without thereby departing from the scope of the present invention.

Thus, for example, the system described above may also operate so as to keep the communication between the openings 48 and 50 and the chamber 56 always open, that is, even with the slide 38 in the rest position.

We claim:

1. A fuel injection pump for diesel engines, including: at least one cylinder defining a pressure chamber, a radial fuel intake opening communicating with the pressure chamber, a delivery passage for the pumped fuel which is connectible to the pressure chamber, and a fuel return opening;

a piston which is sealingly and reciprocatingly slidable in the cylinder and arranged to cut off communication between the pressure chamber and the fuel intake opening during its pumping stroke, the piston being rotatable in the cylinder and having a helical groove in its lateral surface and an axial hole which communicates with the groove and opens into the pressure chamber, said groove also cooperating with the fuel return opening to regulate the delivery by means of rotational movements of the piston, and an external regulating member for effecting rotatable movements of the piston, wherein the improvement consists in a slide valve and an associated resilient biasing member being inserted in the cylinder, the slide valve defining a side of the pressure chamber opposite the piston and controlling the communication between the pressure chamber and the fuel delivery passage, the slide valve being movable from an initial equilibrium position in the direction of a pumping movement of the piston against the action of the resilient biasing member, wherein said initial equilibrium position of the slide valve is dependent on the supply pressure of the fuel and external modulating means is provided for modulating the supply pressure so as to vary the initial equilibrium position of the slide valve.

2. Fuel injection pump as defined in claim 1, wherein the slide valve defines internal passages and is inserted in a tubular connector fitted to the top of the cylinder, said connector having an internal circumferential groove which communicates with the delivery passage and can communicate with the pressure chamber through the internal passages in the slide valve at the end of the travel of the latter against the action of said resilient biasing member.

* * * * *